US007631996B2

(12) United States Patent
Huang

(10) Patent No.: US 7,631,996 B2
(45) Date of Patent: Dec. 15, 2009

(54) LAMP SHADE AND METHOD FOR FORMING OPTICAL STRIPES ON THE SURFACE OF THE LAMP SHADE

(76) Inventor: Chao-Chun Huang, No. 95, Jhonghe St., Taiping City, Taichung County (TW)

( * ) Notice: Subject to any disclaimer, the term of this patent is extended or adjusted under 35 U.S.C. 154(b) by 121 days.

(21) Appl. No.: 11/901,861

(22) Filed: Sep. 19, 2007

(65) Prior Publication Data

US 2009/0073711 A1 Mar. 19, 2009

(51) Int. Cl.
*F21V 5/02* (2006.01)

(52) U.S. Cl. ..... 362/518; 362/602; 362/605; 362/610; 362/557

(58) Field of Classification Search ..... 362/55–560, 362/600–632
See application file for complete search history.

(56) References Cited

U.S. PATENT DOCUMENTS 6,193,385 B1 * 2/2001 Maki et al. ..... 362/108
6,461,007 B1 * 10/2002 Akaoka ..... 362/610
6,631,998 B2 * 10/2003 Egawa et al. ..... 362/612
6,769,138 B2 * 8/2004 Golle et al. ..... 2/102
6,827,474 B2 * 12/2004 Clapper ..... 362/557
6,992,335 B2 * 1/2006 Ohkawa ..... 257/98
7,223,006 B2 * 5/2007 Sugiura ..... 362/616

* cited by examiner

*Primary Examiner*—Anabel M Ton
(74) *Attorney, Agent, or Firm*—Charles E. Baxley

(57) ABSTRACT

A lamp shade includes a light permeable bottom layer and a light reflection structure provided on the light permeable bottom layer and including a plurality of reflective stripes formed and distributed on a surface of a side of the light permeable bottom layer and a plurality of recessed gaps formed between the reflective stripes and each located between any two adjacent reflective stripes. Each of the recessed gaps has a depth direction extending into a thickness direction of the light permeable bottom layer. Thus, the light patterns of the lamp shade will produce variations by provision of the reflective stripes and the recessed gaps of the light reflection structure, thereby enhancing the aesthetic quality of the lamp shade.

14 Claims, 9 Drawing Sheets

LAMP SHADE AND METHOD FOR FORMING OPTICAL STRIPES ON THE SURFACE OF THE LAMP SHADE

BACKGROUND OF THE INVENTION

1. Field of the Invention

The present invention relates to an illuminating equipment, and more particularly to a lamp shade and a method for forming optical stripes on the surface of the lamp shade.

2. Description of the Related Art

A conventional lamp shade is made of glass or plastic material that allows passage of the light so that an electric bulb provided in the lamp shade can emit light beams outwardly from the lamp shade to provide a lighting function. However, the surface of the lamp shade has a planar structure so that when the light beams are emitted outwardly from the lamp shade or an ambient light is projected onto the surface of the lamp shade, the light will not produce any variation on the surface of the lamp shade even if patterns are printed on the surface of the lamp shade, thereby limiting the outer appearance of the lamp shade.

SUMMARY OF THE INVENTION

The present invention is to mitigate and/or obviate the disadvantage of the conventional lamp shade.

The primary objective of the present invention is to provide a lamp shade, wherein the light patterns of the lamp shade will produce variations by provision of the reflective stripes and the recessed gaps of the light reflection structure, thereby enhancing the aesthetic quality of the lamp shade.

Another objective of the present invention is to provide a lamp shade, wherein when an ambient light is projected onto the surfaces of the reflective stripes, the reflected light from the reflective stripes produces different reflective directions and intensities so that when the reflective stripes reflect the ambient light onto an inspector's eyes, the reflective stripes form specific patterns or provide specific viewing effects by distribution of the reflective stripes.

A further objective of the present invention is to provide a lamp shade, wherein the reflective stripes and the recessed gaps of the light reflection structure are formed or provided on the light permeable bottom layer easily, quickly and exactly, thereby facilitating fabrication of the lamp shade, and thereby decreasing the costs of fabrication.

In accordance with one embodiment of the present invention, there is provided a lamp shade, comprising:

a light permeable bottom layer;

a light reflection structure provided on the light permeable bottom layer and including:

a plurality of reflective stripes formed and distributed on a surface of a side of the light permeable bottom layer;

a plurality of recessed gaps formed between the reflective stripes and each located between any two adjacent reflective stripes;

wherein each of the recessed gaps has a depth direction extending into a thickness direction of the light permeable bottom layer. Preferably, the reflective stripes form a pattern.

In accordance with one embodiment of the present invention, there is provided a method for forming reflective stripes on a surface of a lamp shade, comprising:

preparing a bottom layer that is made of light permeable material;

forming a reflective plated layer on a surface of the bottom layer by a plating process;

applying a force to press the plated layer by a cutting tool which has predetermined patterns and stripes to form a plurality of reflective stripes and a plurality of recessed gaps on the plated layer, wherein each of the recessed gaps is located between any two adjacent reflective stripes and has a depth extending into the bottom layer.

Further benefits and advantages of the present invention will become apparent after a careful reading of the detailed description with appropriate reference to the accompanying drawings.

DETAILED DESCRIPTION OF THE INVENTION

Figure 1:
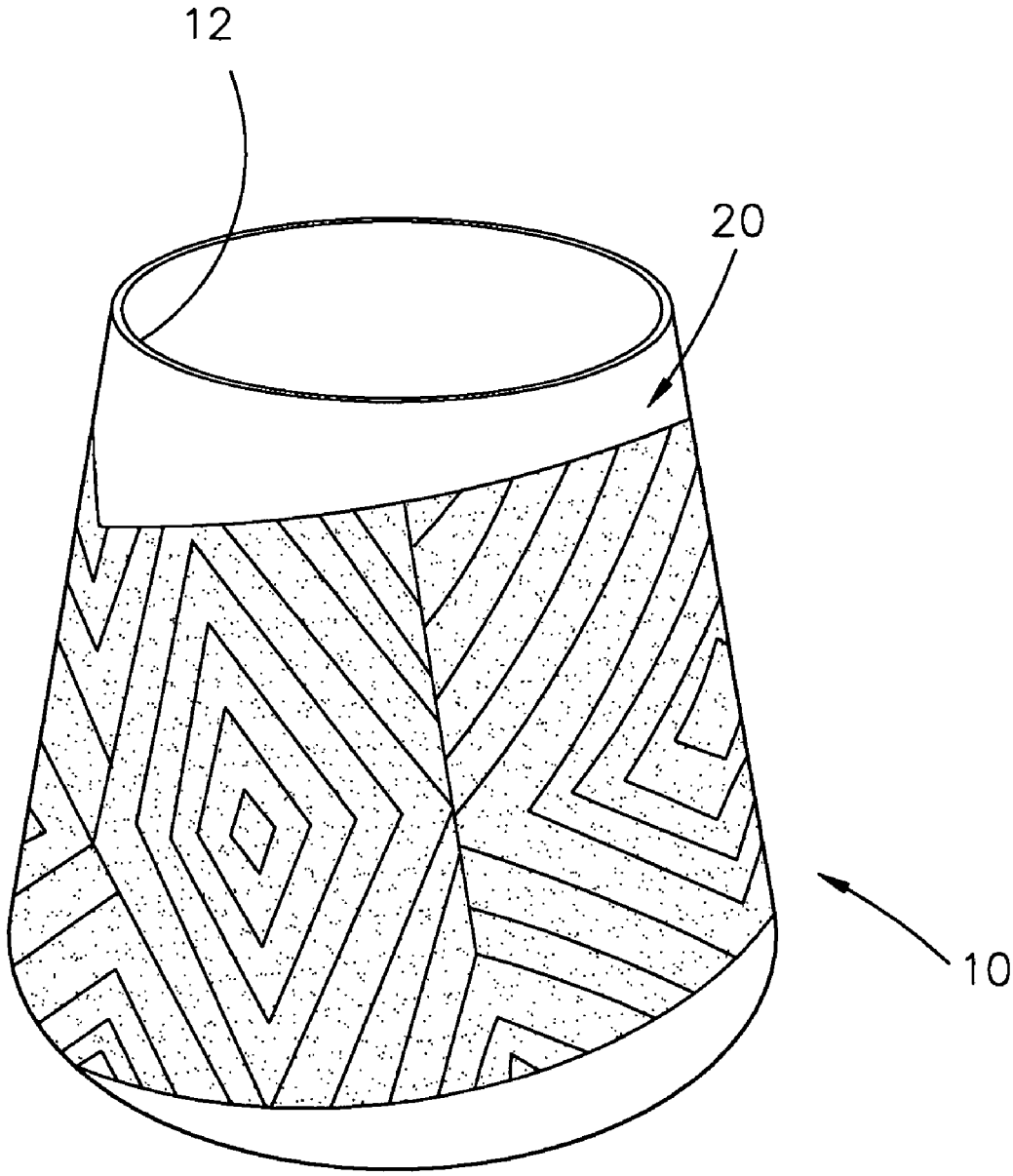
FIG. 1 is a perspective view of a lamp shade in accordance with the preferred embodiment of the present invention.

Referring to the drawings and initially to FIG. 1, a lamp shade 10 in accordance with the preferred embodiment of the present invention comprises a light permeable bottom layer 12, and a light reflection structure 20 formed or provided on a surface of a side of the light permeable bottom layer 12.

Figure 2:
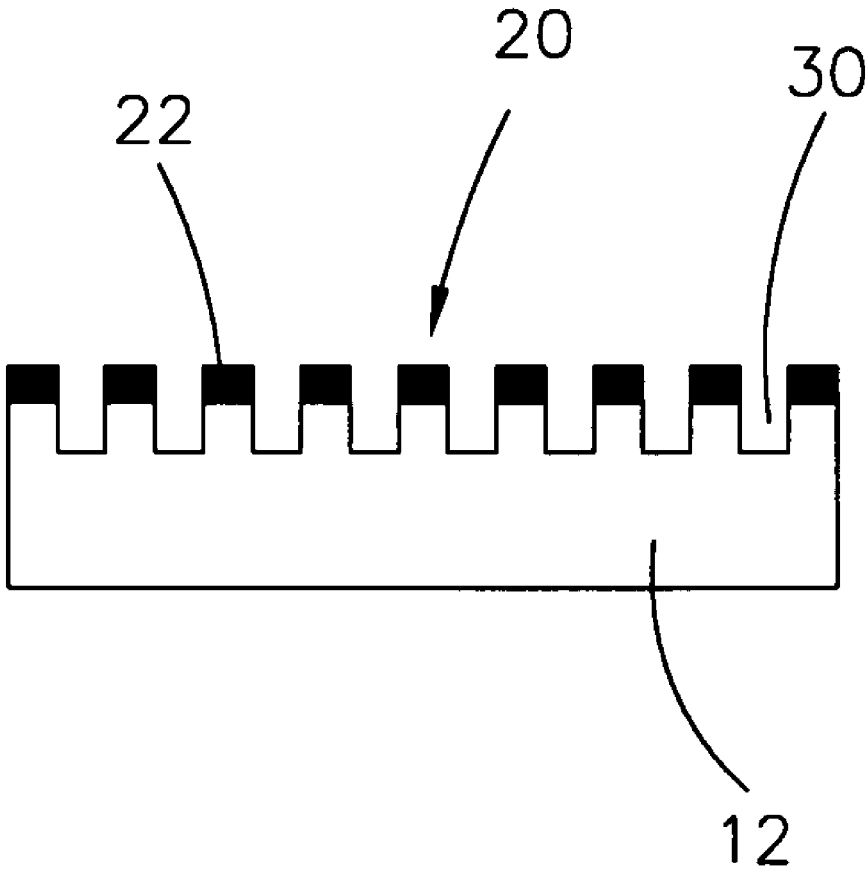
FIG. 2 is a locally planar view of the lamp shade as shown in FIG. 1.

Referring to FIG. 2, the light reflection structure 20 includes a plurality of reflective stripes 22 and a plurality of recessed gaps 30 formed between the reflective stripes 22 and each located between any two adjacent reflective stripes 22. Each of the recessed gaps 30 has a depth direction extending into a thickness direction of the light permeable bottom layer 12.

Figure 3:
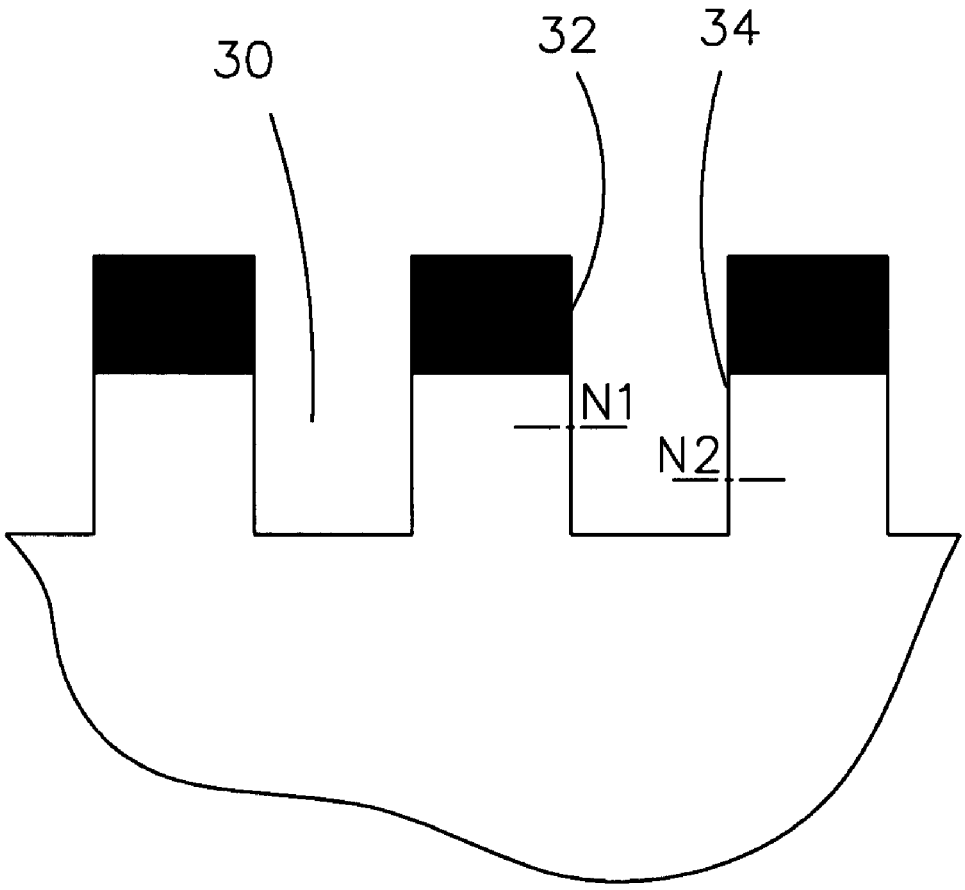
FIG. 3 is a locally enlarged view of the lamp shade as shown in FIG. 2.

Referring to FIG. 3, each of the recessed gaps 30 has a first side 32 and a second side 34 opposite to the first side 32. The first side 32 of each of the recessed gaps 30 has a first normal line N1, and the second side 34 of each of the recessed gaps 30 has a second normal line N2 parallel with the first normal line N1 of the first side 32.

Figure 4:
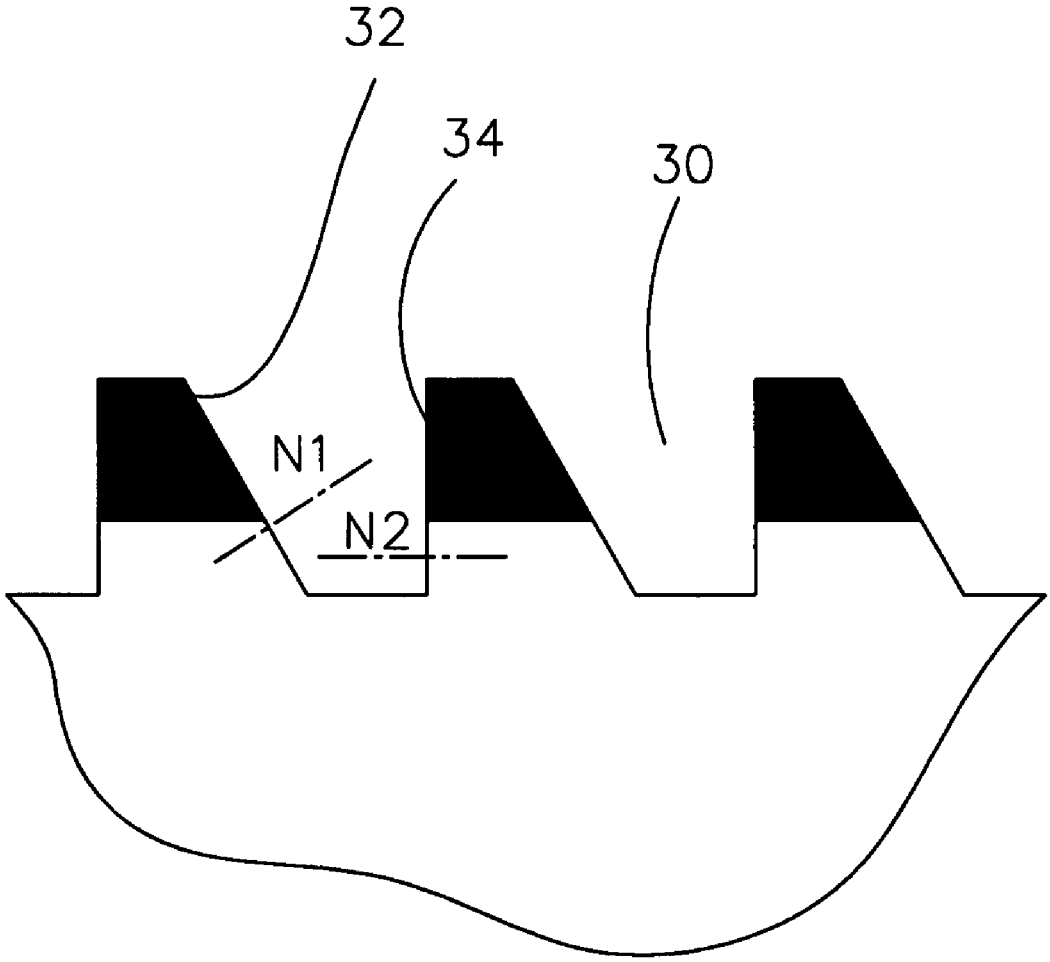
FIG. 4 is a locally enlarged view of the lamp shade in accordance with another preferred embodiment of the present invention.

Referring to FIG. 4, the first side 32 of each of the recessed gaps 30 is disposed at an inclined state, and the second side 34 of each of the recessed gaps 30 is not parallel with the first side 32. Thus, the second normal line N2 of the second side 34 of each of the recessed gaps 30 is not parallel with the first normal line N1 of the first side 32.

Figure 5:
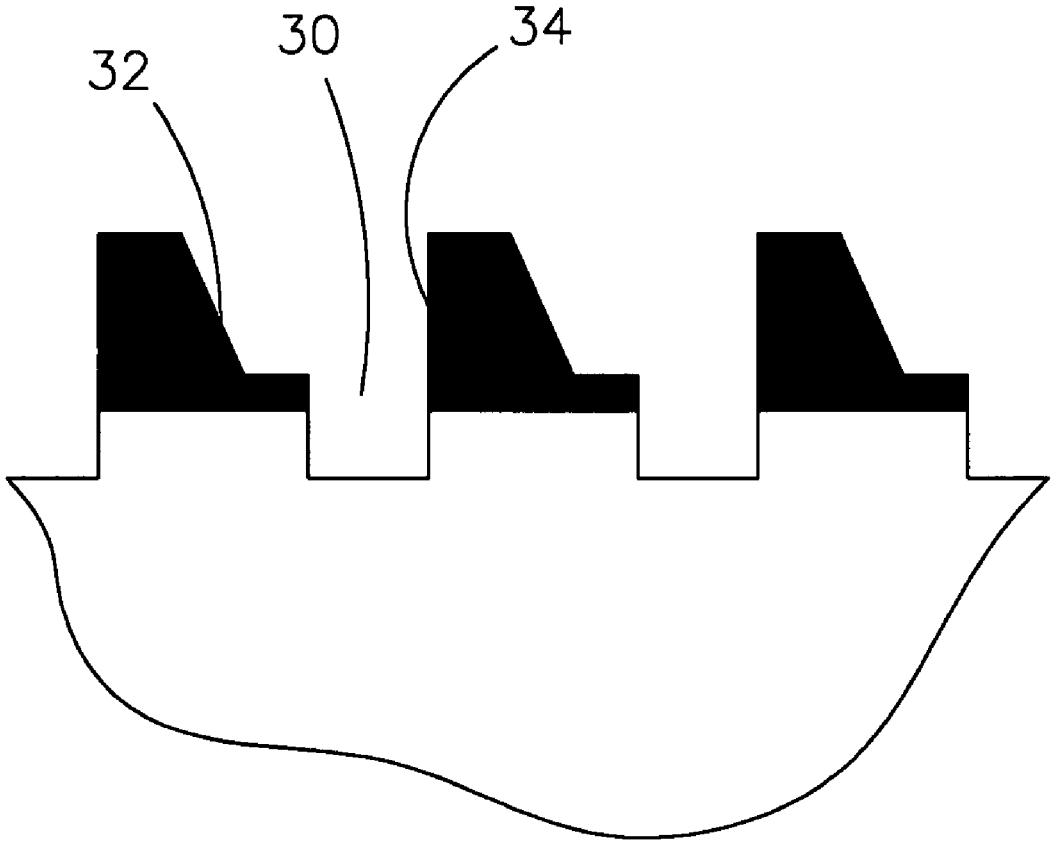
FIG. 5 is a locally enlarged view of the lamp shade in accordance with another preferred embodiment of the present invention.

Referring to FIG. 5, the first side 32 of each of the recessed gaps 30 has a stepped shape, and the second side 34 of each of the recessed gaps 30 has a planar shape.

In practice, when an electric bulb (not shown) provided in the lamp shade 10 emits light beams outwardly from the lamp shade 10, one part of the light beams passes through the light permeable bottom layer 12 and is projected outwardly from the recessed gaps 30 to the ambient environment, and the other part of the light beams contacts with and is reflected backward by the reflective stripes 22 onto the lamp shade 10 to enhance a contrast between the reflective stripes 22 on the surface of the lamp shade 10 and the light beams of the electric bulb, so that patterns formed by the reflective stripes 22 provide an outstanding effect.

Figure 6:
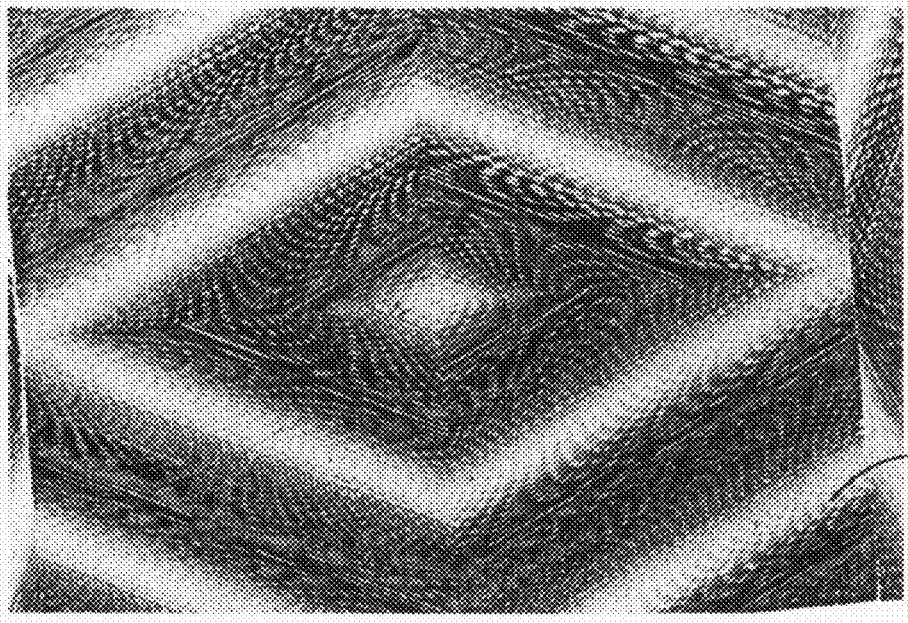
FIG. 6 is a locally planar view showing a plurality of reflective stripes for reflecting the ambient light.

Referring to FIG. 6, the reflective stripes 22 are arranged in different directions, and any two adjacent reflective stripes 22 may have different distances. In such a manner, when an ambient light is projected onto the surfaces of the reflective stripes 22, the reflective stripes 22 have different distances and angles so that the reflected light from the reflective stripes 22 produces different reflective directions and intensities. Thus, when the reflective stripes 22 reflect the ambient light onto an inspector's eyes, the reflective stripes 22 form specific patterns or provide specific viewing effects by distribution of the reflective stripes 22.

Figure 7:
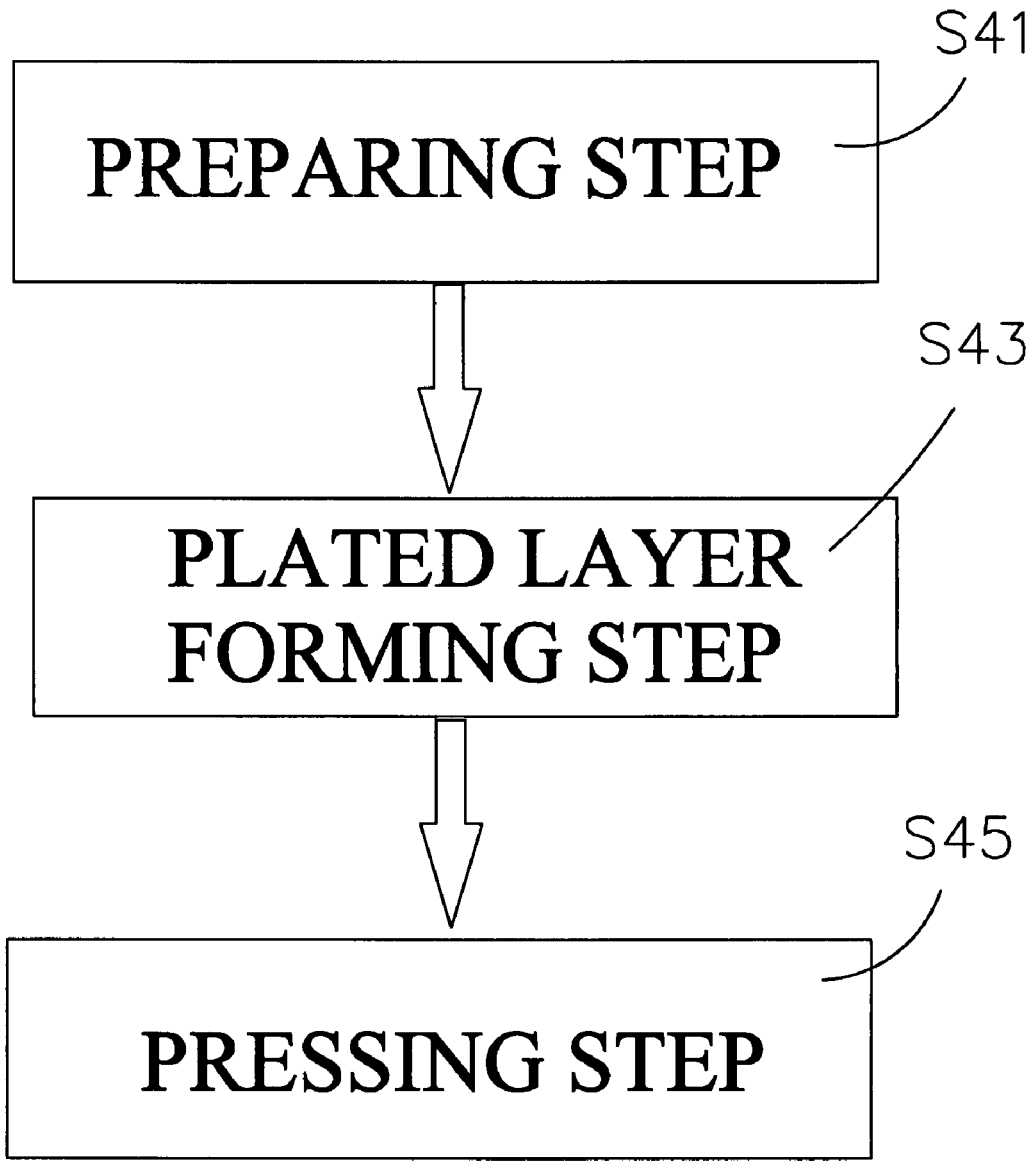
FIG. 7 is a flow chart of a method for forming the reflective stripes on the surface of the lamp shade as shown in FIG. 1.

Referring to FIG. 7, a method for forming the reflective stripes 22 on the surface of the lamp shade 10 in accordance with the preferred embodiment of the present invention comprises a preparing step S41, a plated layer forming step S43, and a pressing step S45.

Figure 8:
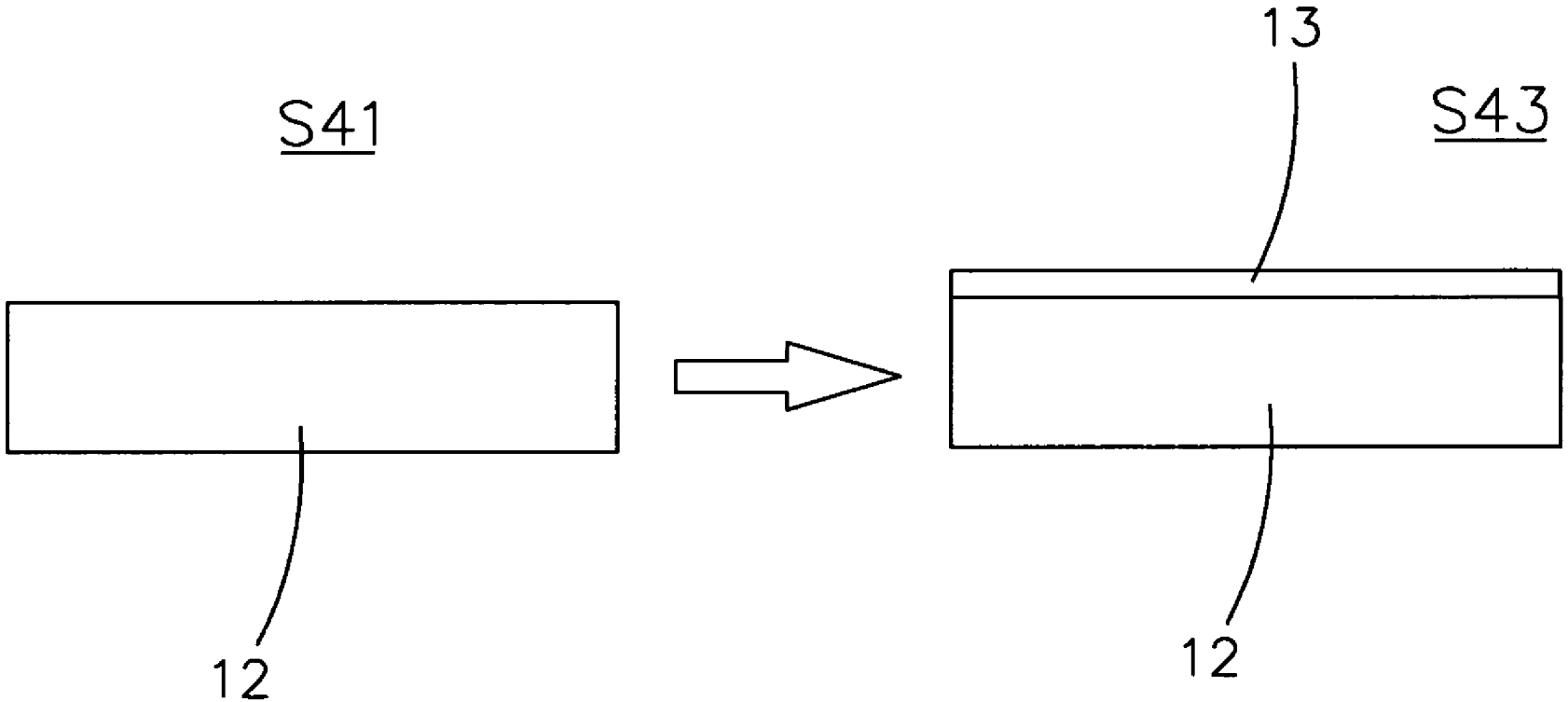
FIG. 8 is a flow chart showing the plated layer forming step of the method as shown in FIG. 7.

Referring to FIG. 8, the preparing step S41 includes preparing a bottom layer 12 that is made of light permeable material. The bottom layer 12 is preferably made of plastic material. The plated layer forming step S43 includes forming a plated layer 13 on a surface of the bottom layer 12 by a plating process, such as evaporation plating, sputter plating or electroplating. The plated layer 13 is preferably made of a reflective metallic material and has a thickness much smaller than that of the bottom layer 12.

Figure 9:
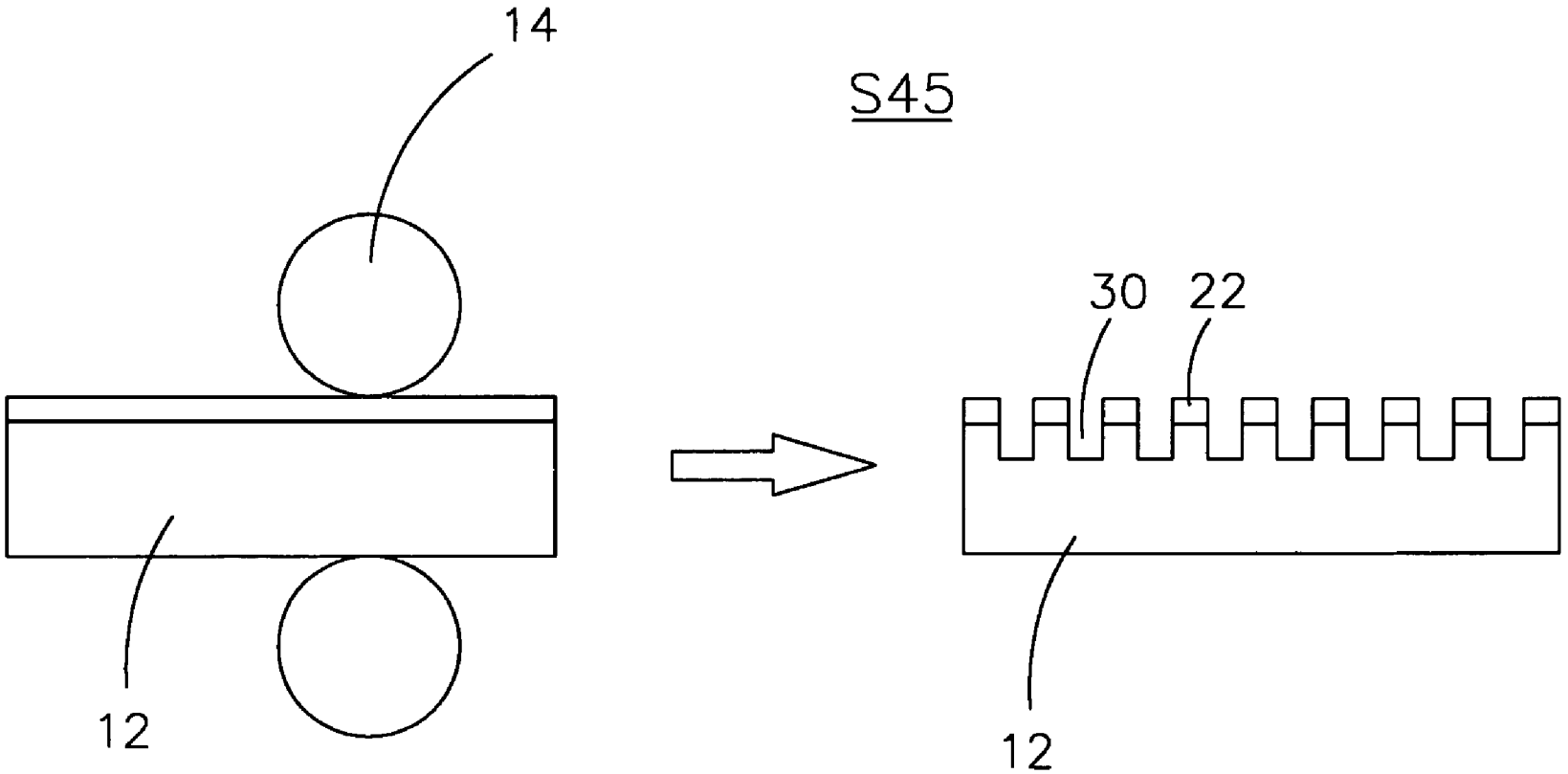
FIG. 9 is a flow chart showing the pressing step of the method as shown in FIG. 7.

Referring to FIG. 9, the pressing step S45 includes applying a force to press the plated layer 13 by a cutting tool 14 which has predetermined patterns and stripes to form a plurality of reflective stripes 22 and a plurality of recessed gaps 30 on the plated layer 13, wherein each of the recessed gaps 30 is located between any two adjacent reflective stripes 22 and has a depth extending into the bottom layer 12.

In the preferred embodiment of the present invention, the recessed gaps 30 has a distribution density of about five to eight (5 to 8) pieces per millimeter (mm) width, each of the recessed gaps 30 has a depth of about 0.01 to 0.05 millimeter (mm), and the cutting tool 14 presses the plated layer 13 by rolling or stamping.

Accordingly, the light patterns of the lamp shade 10 will produce variations by provision of the reflective stripes 22 and the recessed gaps 30 of the light reflection structure 20, thereby enhancing the aesthetic quality of the lamp shade 10. In addition, when an ambient light is projected onto the surfaces of the reflective stripes 22, the reflected light from the reflective stripes 22 produces different reflective directions and intensities so that when the reflective stripes 22 reflect the ambient light onto an inspector's eyes, the reflective stripes 22 form specific patterns or provide specific viewing effects by distribution of the reflective stripes 22. Further, the reflective stripes 22 and the recessed gaps 30 of the light reflection structure 20 are formed or provided on the light permeable bottom layer 12 easily, quickly and exactly, thereby facilitating fabrication of the lamp shade 10, and thereby decreasing the costs of fabrication.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A lamp shade, comprising:

a light permeable bottom layer; and a light reflection structure provided on the light permeable bottom layer and including:

a plurality of reflective stripes formed and distributed on a surface of a side of the light permeable bottom layer; and a plurality of recessed gaps formed between the reflective stripes and each located between any two adjacent reflective stripes;

wherein each of the recessed gaps has a depth direction extending into a thickness direction of the light permeable bottom layer, and the recessed gaps has a distribution density of about five to eight (5 to 8) pieces per millimeter (mm) width.

2. A lamp shade, comprising:

a light permeable bottom layer; and a light reflection structure provided on the light permeable bottom layer and including:

a plurality of reflective stripes formed and distributed on a surface of a side of the light permeable bottom layer; and a plurality of recessed gaps formed between the reflective stripes and each located between any two adjacent reflective stripes;

wherein each of the recessed gaps has a depth direction extending into a thickness direction of the light permeable bottom layer, and each of the recessed gaps has a depth of about 0.01 to 0.05 millimeter (mm).

3. A lamp shade, comprising:

a light permeable bottom layer; and a light reflection structure provided on the light permeable bottom layer and including:

a plurality of reflective stripes formed and distributed on a surface of a side of the light permeable bottom layer; and a plurality of recessed gaps formed between the reflective stripes and each located between any two adjacent reflective stripes, wherein:

each of the recessed gaps has a depth direction extending into a thickness direction of the light permeable bottom layer;

each of the recessed gaps has a first side and a second side opposite to the first side;

the first side of each of the recessed gaps has a first normal line; and the second side of each of the recessed gaps has a second normal line which is not parallel with the first normal line of the first side.

4. The lamp shade in accordance with claim 3, wherein the first side of each of the recessed gaps is disposed at an inclined state, and the second side of each of the recessed gaps is not parallel with the first side.

5. The lamp shade in accordance with claim 3, wherein the first side of each of the recessed gaps has a stepped shape; and the second side of each of the recessed gaps has a planar shape.

6. The lamp shade in accordance with claim 3, wherein the reflective stripes are arranged in different directions.

7. The lamp shade in accordance with claim 3, wherein any two adjacent reflective stripes have different distances and angles.

8. A method for forming reflective stripes on a surface of a lamp shade, comprising:

preparing a bottom layer that is made of light permeable material;

forming a reflective plated layer on a surface of the bottom layer by a plating process; and applying a force to press the plated layer by a cutting tool which has predetermined patterns and stripes to form a plurality of reflective stripes and a plurality of recessed gaps on the plated layer, wherein each of the recessed gaps is located between any two adjacent reflective stripes and has a depth extending into the bottom layer.

9. The method in accordance with claim 8, wherein the plated layer is made of a reflective metallic material.

10. The method in accordance with claim 8, wherein the plated layer has a thickness much smaller than that of the bottom layer.

11. The method in accordance with claim 8, wherein the plating process is evaporation plating, sputter plating or electroplating.

12. The method in accordance with claim 8, wherein the cutting tool presses the plated layer by rolling or stamping.

13. The method in accordance with claim 8, wherein the recessed gaps has a distribution density of about five to eight (5 to 8) pieces per millimeter (mm) width.

14. The method in accordance with claim 8, wherein each of the recessed gaps has a depth of about 0.01 to 0.05 millimeter (mm).

* * * * *